United States Patent [19]

Kosto

[11] 4,179,287

[45] Dec. 18, 1979

[54] METHOD FOR ADDING MANGANESE TO A MOLTEN MAGNESIUM BATH

[75] Inventor: Timothy J. Kosto, Youngstown, N.Y.

[73] Assignee: Union Carbide Corporation, New York, N.Y.

[21] Appl. No.: 970,983

[22] Filed: Dec. 19, 1978

[51] Int. Cl.[2] ..... C22C 1/02

[52] U.S. Cl. ..... 75/168 E; 75/67 R

[58] Field of Search ..... 75/67 A, 67 R, 168 E, 75/168 M

[56] References Cited

U.S. PATENT DOCUMENTS

| | | | |
|---|---|---|---|
| 2,474,538 | 6/1949 | Mahoney et al. | 75/168 |
| 2,620,270 | 12/1952 | Haney et al. | 75/67 |
| 2,774,664 | 12/1956 | McDonald | 75/168 |
| 3,592,637 | 7/1971 | Brown et al. | 75/138 |

OTHER PUBLICATIONS

"Principles of Magnesium Technology", E. F. Emley, Pergamon Press, 1966, pp. 92–93.

"Electrolytic Mn and Its Alloys", R. S. Dean, The Ronald Press Co., 1952, N.Y., pp. 170–173.

"Mg and Its Alloys", C. S. Roberts, John Wiley, N.Y., 1960, pp. 141–143.

Metals Handbook, 8th Edition, vol. 5, "Forging & Casting", ASM., 1970, pp. 433–435.

*Primary Examiner*—L. Dewayne Rutledge
*Assistant Examiner*—Upendra Roy
*Attorney, Agent, or Firm*—J. Hart Evans

[57] ABSTRACT

A method for the addition of manganese to a molten magnesium bath by mixing the manganese to be dissolved in a finely divided form with magnesium in a finely divided form and adding the mixture to the molten magnesium.

12 Claims, 1 Drawing Figure

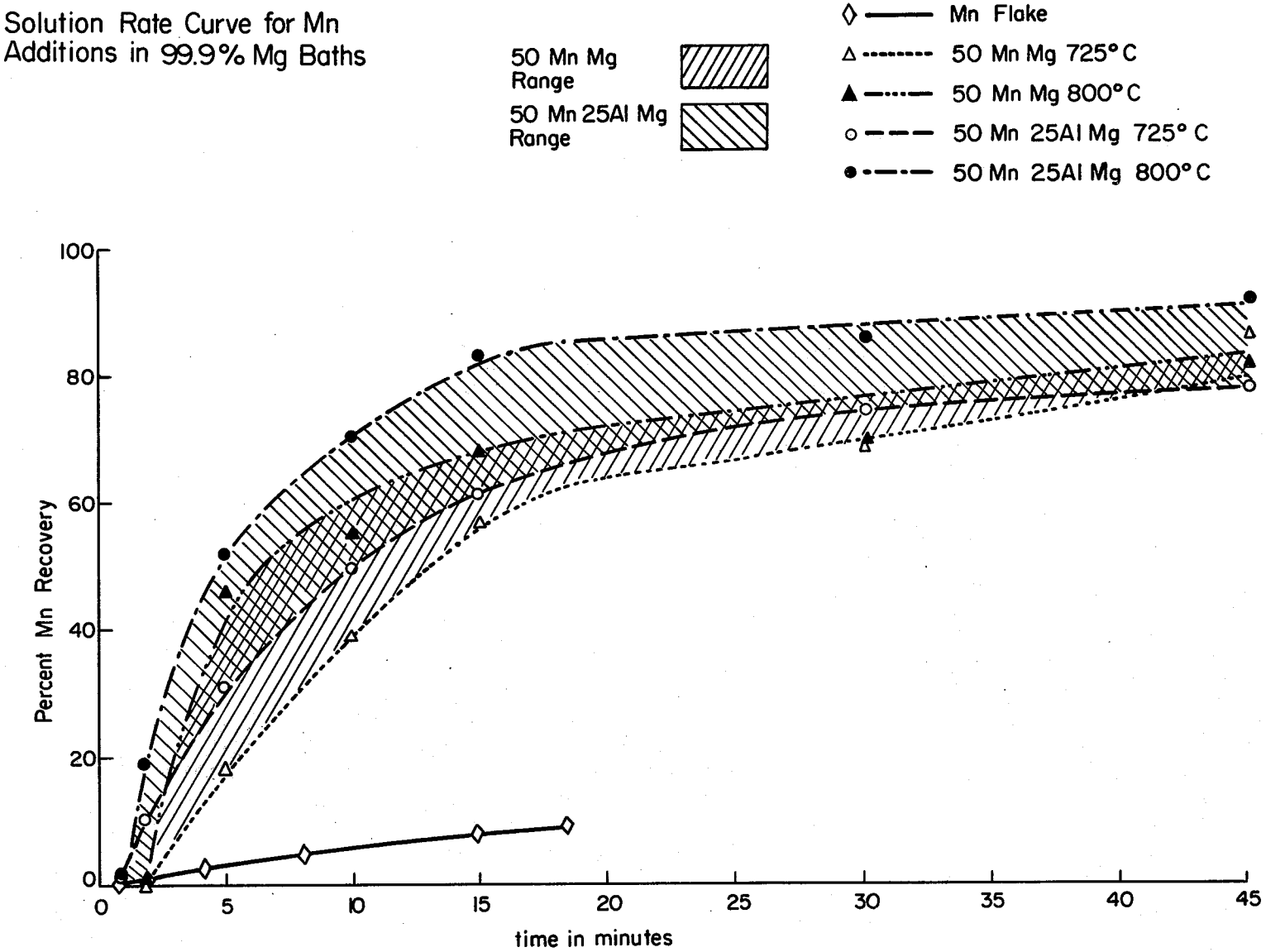
Solution Rate Curve for Mn Additions in 99.9% Mg Baths
Mn Flake
50 Mn Mg 725° C
50 Mn Mg 800° C
50 Mn 25Al Mg 725° C
50 Mn 25Al Mg 800° C
50 Mn Mg Range
50 Mn 25Al Mg Range
Percent Mn Recovery
0
20
40
60
80
100
time in minutes
0
5
10
15
20
25
30
35
40
45

METHOD FOR ADDING MANGANESE TO A MOLTEN MAGNESIUM BATH

This invention relates to the addition of manganese to a molten magnesium bath. More particularly, the present invention relates to the addition of a blended mixture of finely divided manganese and magnesium to a molten magnesium bath which addition has an improved solution rate in the molten magnesium bath as compared to an addition of elemental manganese by itself.

The manufacture of magnesium, in many instances, requires the addition of manganese for refining and alloying. For example, manganese is added to magnesium in amounts of up to about 2 percent by weight for the purpose of removing iron from the bath and improving the corrosion resistance and mechanical properties of the cast magnesium product.

A common prior art practice in metallurgical operations for adding manganese to magnesium is by chemical reaction of $MnCl_2$ with magnesium in the bath or to dissolve solid elemental manganese, e.g., electrolytic manganese flake (Elmang* flake) in a molten magnesium bath. These practices are discussed, for example, in "Principles of Magnesium Technology" by E.F. Emley, Pergamon Press, 1966; pages 92–93.

*Trademark of UCC

The known technique for the addition of manganese into a molten magnesium bath by the addition of a manganese compound such as manganese chloride according to the following equation: $MnCl_2+Mg \rightarrow Mn+MgCl_2$ has several disadvantages. A cost premium is inherent in the production of the $MnCl_2$ required for the process. Further, there is an additional economic desadvantage due to the necessity of removing one mole of magnesium from the bath for each mole of manganese added as shown in the above equation. Manganese efficiencies of only about 50 to 80 percent are obtained at typical bath temperatures of 750° C. depending on the care with which the process is conducted.

The dissolution of elemental manganese into a molten magnesium bath also presents disadvantages. Typical commercial recoveries are only about 50 to 80 percent and involve long dissolution times. As manganese has a melting point of 1245° C. while magnesium has a melting point of 650° C. a typical electrolytic manganese additive (e.g., Elmang* flake) takes approximately 2 hours to dissolve at a usual magnesium bath temperature of 750° to 800° C.

*Trademark of UCC

U.S. Pat. No. 3,592,634-Brown et. al. discloses a method for the rapid dissolution of manganese in metal baths, e.g. aluminum, titanium, iron and copper, through the use of promoter elements aluminum or silicon but does not disclose the use of magnesium as a promoter.

It is therefore an object of the present invention to provide for the economical, efficient addition of manganese to magnesium without the contamination of the magnesium.

Other objects of this invention will be apparent from the following description and claims taken in conjunction with the drawing wherein:

The single FIGURE shows the improved percent recovery of manganese in a magnesium bath with respect to time in accordance with the present invention in comparison with the recovery of electrolytic manganese.

The present invention comprises a method for the making of manganese additions to a molten magnesium bath by introducing into the molten magnesium bath a blended mixture of finely divided manganese and magnesium. In the present invention, the manganese metal addition is substantially dissolved in the molten magnesium bath at a rate substantially greater than that which would be obtained by the addition of elemental manganese.

The improvement of the present invention is a method which results in the economical, rapid, and efficient addition of manganese to magnesium.

In the present invention it has been discovered that when finely divided manganese is blended with finely divided magnesium and the mixture is introduced into a molten magnesium bath, coaction between these metals in the molten metal bath causes the manganese to be rapidly dissolved in the magnesium bath.

In the practice of a particular embodiment of the present invention, finely divided manganese and finely divided magnesium are mixed together. The finely divided manganese and magnesium particles are suitably all substantially finer than[8] mesh (8×D) and preferably substantially all finer than 30 mesh (30×D). It has been found to be particularly advantageous for all particles to be sized 20 mesh (20×D) and finer. The proportions of the aggregate of the coacting manganese and magnesium constituents suitably are such that the ratio of manganese to magnesium by weight in the mixture is from about ¼ to 8 and the ratio of magnesium to manganese by weight in the mixture is from about 4 to ⅛. The preferred proportions of the mixture range between 40% and 60 percent by weight manganese and between 60 percent to 40 percent by weight magnesium. The most preferred mixture is 50 percent by weight manganese and 50 percent by weight magnesium. In the practice of the invention, it is preferred to use commercially pure magnesium (e.g., ASTM B-92 grade 9990A) and electrolytic manganese (e.g., Elmang* flake). However, alloys of magnesium or manganese may be used. Examples of suitble magnesium alloys would include commercial magnesium based alloys containing greater than about 90 percent magnesium, e.g. magnesium-aluminum, magnesium-zinc or magnesium-aluminum-zinc alloys. Examples of suitable manganese alloys would include ferro-manganese and massive manganese.

*Trademark of UCC

It has been found that up to 50 percent of the magnesium in the blended manganese-magnesium mixture may be replaced by aluminum without any detrimental effect on the coaction between the metals wherein the manganese is dissolved in the molten magnesium bath. However, in some applications those skilled in the art may find the simultaneous addition of aluminum and manganese to the bath undesirable.

The manganese and magnesium in the blended mixture in the practice of the present invention suitably constitute about 70 percent by weight of the mixture and preferably constitute at least 95 percent by weight of the mixture.

In the practice of the present invention, the finely divided manganese and magnesium mixture is added to a conventional molten magnesium bath e.g., 99.9% commercially pure electrolytic magnesium such as ASTM B-92 grade 9990A. The molten magnesium in the bath is suitably at a temperature of 690° C. to 800° C. and preferably 700° C. to 760° C.

In the preferred embodiment of the present invention, the manganese and magnesium mixture is added to the molten magnesium bath in the form of compacts or pellets. The finely divided manganese and magnesium mixture is compressed or compacted into the form of a compact or pellet which preferably has a sufficient density so to sink of its own weight into the molten magnesium bath. The density of the compact suitably ranges from about 2.1 to 3.0g./cc with the density being about 80 to 97 percent the maximum theoretical density of the manganese-magnesium mixture selected. (The maximum theoretical density is that of melted fully alloyed constitutents.)

Preferably, the density is about 90–97 percent the maximum theoretical density. For the most preferred mixture of 50 percent by weight manganese and 50 percent by weight magnesium, the preferred density of the compact is 2.7 g./cc which corresponds to 97 percent the maximum theoretical density. The amount of manganese added to the bath is controlled by the amount of manganese present in a compact and the number of compacts added. Manganese additions of up to 2 percent by weight can be readily made.

To more particularly illustrate the present invention various tests were performed as described in the following examples:

EXAMPLE I

A bath of 99.9% commercially pure molten ASTM B-92 grade 9990A magnesium (1.45kg.) under argon was stabilized at 725° C. in a graphite crucible using an induction furnace to establish the bath temperature. The surface of the magnesium bath was covered with a melting flux comprising a KCl, $MgCl_2$, $BaCl_2$ and $CaF_2$ composition. A 1.38% addition (20 grams) of manganese based on the weight of molten magnesium in the bath was added as electrolytic manganese flake (Elmang* flake) of the approximate size of 12 mm×12 mm×3 mm lumps. At various time increments listed below, samples were taken from the bath and analyzed for manganese:

| Time From Addition Minutes | % Mn (analysis) Dissolved | % Mn Recovery |
|---|---|---|
| t = 0 | 0.03 | 0 |
| t - 2 | 0.05 | 1.5 |
| t = 4 | 0.07 | 2.9 |
| t = 8 | 0.09 | 4.3 |
| t = 15 | 0.14 | 8.0 |
| t = 18 | 0.16 | 9.4 |

*Trademark of UCC

The percent manganese (analysis) in the preceding table is the percent manganese by weight dissolved in the bath at the time indicated. The percent manganese recovered is calculated by the following formula:

$$\% \text{ Mn Recovery} = \frac{\% \text{ Mn (analysis)} - \% \text{ Mn (base)}}{\% \text{ Mn (added)}} \times 100\%$$

The % Mn (base) is the manganese analyzed at time t=O and represents the manganese, if any, present in the magnesium bath prior to the manganese addition. The foregoing data is plotted conventionally in the Figure of the drawing which shows percent manganese recovered against the time from the addition of the electrolytic manganese to the bath.

EXAMPLE 2

A series of tests were conducted in which pellets of a blended 50% manganese and 50% magnesium mixture in accordance with the present invention were added to a molten magnesium bath at various bath temperatures so as to provide manganese additions of 0.5, 1.0 and 1.5 percent based on the weight of molten magnesium in the bath. Also tests were run using pellets in which half the magnesium in the pellets was replaced by aluminum, i.e., a blended 50% manganese, 25% magnesium and 25% aluminum mixture.

The manganese in the mixtures was 100% finely divided electrolytic manganese flake (Elmang* flake). The magnesium was finely divided 99.9% commercially pure magnesium (ASTM B-92 grade 9990A). The aluminum was finely divided 99.8% commercially pure aluminum powder. The mixtures were blended with a blending aid and the mixture was then pressed into pellets in a hydraulic press at the pressures indicated.

*Trademark of UCC

The bath was a 99.9% commercially pure molten magnesium (ASTM B-92 grade 9990A) under argon stabilized at temperature in a graphite crucible using an induction furnace to establish bath temperature. The surface of the magnesium bath was covered with a melting flux comprising a KCl, $MgCl_2$, $BaCl_2$ and $CaF_2$ composition.

The parameters for and the results of these tests are as shown in tables 1 through 21 wherein the percent manganese recovered was calculated in the manner hereinbefore described.

TABLE 1

Pellet Composition 50 Mn 50 Mg
Bath Temperature 725° C.
Percent Mn Addition 0.5%
Weight of Molten Mg in Bath 1400 g
Particles Sizes −35 mesh
Pellet Weight 14 g Diameter 25.4 mm Thickness 11 mm
Pellet Density 2.50 g/cc % Max. Theoretical Density 89
Compression Force 210 × $10^6$ Pa
Number of Pellets Added 1

Heat No. 206

| TIME FROM ADDITION MINUTES | % Mn (analysis) | % Mn RECOVERY |
|---|---|---|
| 0 | <0.03 | — |
| 1 | <0.03 | — |
| 2 | <0.03 | — |
| 5 | 0.19 | 32 |
| 10 | 0.28 | 50 |
| 15 | 0.34 | 62 |
| 30 | 0.43 | 80 |
| 45 | 0.43 | 80 |

TABLE 2

Pellet Composition 50 Mn 50 Mg
Bath Temperature 760° C.
Percent Mn Addition 0.5%
Weight of Molten Mg in Bath 1400 g
Particles Sizes −35 mesh
Pellet Weight 14 g Diameter 25.4 mm Thickness 11 mm
Pellet Density 2.50 g/cc % Max. Theoretical Density 89
Compression Force 210 × $10^6$ Pa
Number of Pellets Added 1

Heat No. 207

| TIME FROM ADDITION MINUTES | % Mn (analysis) | % Mn RECOVERY |
|---|---|---|
| 0 | <0.03 | — |
| 1 | <0.03 | — |

TABLE 2-continued

| | | |
|---|---|---|
| 2 | <0.03 | — |
| 5 | 0.21 | 36 |
| 10 | 0.27 | 38 |
| 15 | 0.32 | 58 |
| 30 | 0.37 | 68 |
| 45 | 0.43 | 80 |

TABLE 3

Pellet Composition 50 Mn 50 Mg
Bath Temperature 800° C.
Percent Mn Addition 0.5%
Weight of Molten Mg in Bath 1400 g
Particles Sizes −35 mesh
Pellet Weight 14 g Diameter 25.4 mm Thickness 11 mm
Pellet Density 2.50 g/cc % Max. Theoretical Density 89
Compression Force 210 × $10^6$ Pa
Number of Pellets Added 1

Heat No. 208

| TIME FROM ADDITION Minutes | % Mn (analysis) | % Mn RECOVERY |
|---|---|---|
| 0 | <0.03 | — |
| 1 | <0.03 | — |
| 2 | 0.03 | — |
| 5 | 0.20 | 34 |
| 10 | 0.25 | 44 |
| 15 | 0.24 | 42 |
| 30 | 0.29 | 52 |
| 45 | 0.43 | 80 |

TABLE 4

Pellet Composition 50 Mn 50 Mg
Bath Temperature 725° C.
Percent Mn Addition 1.0%
Weight of Molten Mg in Bath 1500 g
Particles Sizes −35 mesh
Pellet Weight 15 g Diameter 25.4 mm Thickness 11.4 mm
Pellet Density 2.59 g/cc % Max. Theoretical Density 92
Compression Force 263 × $10^6$ Pa
Number of Pellets Added 2

Heat No. CC223

| TIME FROM ADDITION MINUTES | % Mn (analysis) | % Mn RECOVERY |
|---|---|---|
| 0 | <0.03 | — |
| 1 | <0.03 | — |
| 2 | <0.03 | — |
| 5 | 0.12 | 9 |
| 10 | 0.38 | 35 |
| 15 | 0.69 | 66 |
| 30 | 0.76 | 73 |
| 45 | 0.92 | 89 |

TABLE 5

Pellet Composition 50 Mn 50 Mg
Bath Temperature 760° C.
Percent Mn Addition 1.0%
Weight of Molten Mg in Bath 1500 g
Particles Sizes −35 mesh
Pellet Weight 15 g Diameter 25.4 mm Thickness 11.4 mm
Pellet Density 2.59 g/cc % Max. Theoretical Density 92
Compression Force 263 × $10^6$ Pa
Number of Pellets Added 2

Heat No. CC224

| TIME FROM ADDITION MINUTES | % Mn (analysis) | % Mn RECOVERY |
|---|---|---|
| 0 | <0.03 | — |
| 1 | <0.03 | — |
| 2 | 0.034 | 1 |
| 5 | .27 | 24 |
| 10 | .44 | 41 |
| 15 | .59 | 56 |
| 30 | .67 | 64 |

TABLE 5-continued

| | | |
|---|---|---|
| 45 | 1.00 | 97 |

TABLE 6

Pellet Composition 50 Mn 50 Mg
Bath Temperature 800° C.
Percent Mn Addition 1.0%
Weight of Molten Mg in Bath 1500 g
Particles Sizes −35 mesh
Pellet Weight 15 g Diameter 25.4 mm Thickness 11.4 mm
Pellet Density 2.59 g/cc % Max. Theoretical Density 92
Compression Force 263 × $10^6$ Pa
Number of Pellets Added 2

Heat No. CC225

| TIME FROM ADDITION MINUTES | % Mn (analysis) | % Mn RECOVERY |
|---|---|---|
| 0 | <0.03 | — |
| 1 | <0.03 | — |
| 2 | 0.076 | 3.1 |
| 5 | 0.77 | 74 |
| 10 | 0.82 | 79 |
| 15 | 0.90 | 87 |
| 30 | 0.82 | 79 |
| 45 | 0.90 | 87 |

TABLE 7

Pellet Composition 50 Mn 50 Mg
Bath Temperature 725° C.
Percent Mn Addition 1.5%
Weight of Molten Mg in Bath 1500 g
Particles Sizes −35 mesh
Pellet Weight 15 g Diameter 25.4 mm Thickness 11.4 mm
Pellet Density 2.59 g/cc % Max. Theoretical Density 92
Compression Force 263 × $10^6$ Pa
Number of Pellets Added 3

Heat No. CC226

| TIME FROM ADDITION MINUTES | % Mn (analysis) | % Mn RECOVERY |
|---|---|---|
| 0 | <0.03 | — |
| 1 | <0.03 | — |
| 2 | <0.03 | — |
| 5 | 0.24 | 14 |
| 10 | 0.52 | 32.7 |
| 15 | 0.67 | 42.7 |
| 30 | 0.82 | 52.7 |
| 45 | 1.40 | 91.3 |

TABLE 8

Pellet Composition 50 Mn 50 Mg
Bath Temperature 760° C.
Percent Mn Addition 1.5%
Weight of Molten Mg in Bath 1500 g
Particles Sizes −35 mesh
Pellet Weight 15 g Diameter 25.4 mm Thickness 11.4 mm
Pellet Density 2.59 g/cc % Max. Theoretical Density 92
Compression Force 263 × $10^6$ Pa
Number of Pellets Added 3

Heat No. CC227

| TIME FROM ADDITION MINUTES | % Mn (analysis) | % Mn RECOVERY |
|---|---|---|
| 0 | <0.03 | — |
| 1 | <0.03 | — |
| 2 | <0.03 | — |
| 5 | 0.088 | 3.9 |
| 10 | 0.73 | 46.7 |
| 15 | 1.10 | 71.3 |
| 30 | 1.14 | 74.0 |
| 45 | 1.20 | 78.0 |

TABLE 9

Pellet Composition 50 Mn 50 Mg

TABLE 9-continued

Bath Temperature 800° C.
Percent Mn Addition 1.5%
Weight of Molten Mg in Bath 1500 g
Particles Sizes −35 mesh
Pellet Weight 15 g Diameter 25.4 mm Thickness 11.4 mm
Pellet Density 2.59 g/cc % Max. Theoretical Density 92
Compression Force 263 × $10^6$ Pa
Number of Pellets Added 3

Heat No. CC228

| TIME FROM ADDITION MINUTES | % Mn (analysis) | % Mn RECOVERY |
|---|---|---|
| 0 | <0.03 | — |
| 1 | <0.03 | 00 |
| 2 | 0.04 | 0.7 |
| 5 | .49 | 30.7 |
| 10 | .67 | 42.7 |
| 15 | 1.15 | 74.7 |
| 30 | 1.20 | 78.0 |
| 45 | 1.22 | 79.3 |

TABLE 10

Pellet Composition 50 Mn 50 Mg
Bath Temperature 725° C.
Percent Mn Addition 0.5
Weight of Molten Mg in Bath 1400 g
Particles Sizes −20 mesh
Pellet Weight 14 g Diameter 25.4 mm Thickness 11 mm
Pellet Density 2.50 g/cc % Max. Theoretical Density 89
Compression Force 210 × $10^6$ Pa
Number of Pellets Added 1

Heat No. CC187

| TIME FROM ADDITION MINUTES | % Mn (analysis) | % Mn RECOVERY |
|---|---|---|
| 0 | <0.03 | — |
| 1 | <0.03 | — |
| 2 | <0.03 | — |
| 5 | 0.15 | 24 |
| 10 | 0.26 | 46 |
| 15 | 0.34 | 62 |
| 30 | 0.33 | 60 |

Heat No. CC190

| TIME FROM ADDITION MINUTES | % Mn (analysis) | % Mn RECOVERY |
|---|---|---|
| 0 | <0.03 | — |
| 1 | <0.03 | — |
| 2 | <0.03 | — |
| 5 | <0.03 | — |
| 10 | <0.03 | — |
| 15 | 0.03 | — |
| 30 | 0.38 | 70 |

Average % Mn Recovery
For Heats CC187 and CC190

| TIME FROM ADDITION Minutes | Ave % Mn Recovery |
|---|---|
| 0 | — |
| 1 | — |
| 2 | — |
| 5 | 12 |
| 10 | 23 |
| 15 | 31 |
| 30 | 65 |

TABLE 11

Pellet Composition 50 Mn 50 Mg
Bath Temperature 760° C.
Percent Mn Addition 0.5%
Weight of Molten Mg in Bath 1040 g
Particles Sizes −20 mesh
Pellet Weight 10.4 g Diameter 22.2 mm Thickness 10.4 mm
Pellet Density 2.59 % Max. Theoretical Density 92
Compression Force 222 × $10^6$ Pa
Number of Pellets Added 1

TABLE 11-continued

Heat No. 202

| TIME FROM ADDITION MINUTES | % Mn (analysis) | % Mn RECOVERY |
|---|---|---|
| 0 | <0.03 | — |
| 1 | <0.03 | — |
| 2 | <0.03 | — |
| 5 | 0.14 | 22 |
| 10 | 0.26 | 46 |
| 15 | 0.35 | 64 |
| 30 | 0.55 | 104 |
| 45 | 0.52 | 98 |

Heat No. 203

| TIME FROM ADDITION MINUTES | % Mn (analysis) | % Mn RECOVERY |
|---|---|---|
| 0 | <0.03 | — |
| 1 | 0.05 | 4 |
| 2 | 0.09 | 12 |
| 5 | 0.19 | 32 |
| 10 | 0.28 | 50 |
| 15 | 0.34 | 62 |
| 30 | 0.47 | 88 |
| 45 | 0.50 | 94 |

Average % Mn Recovery
For Heats 202 and 203

| TIME FROM ADDITION MINUTES | Ave % Mn RECOVERY |
|---|---|
| 0 | — |
| 1 | 2 |
| 2 | 6 |
| 5 | 27 |
| 10 | 48 |
| 15 | 63 |
| 30 | 96 |
| 45 | 96 |

TABLE 12

Pellet Composition 50 Mn 50 Mg
Bath Temperature 800° C.
Percent Mn Addition 0.5
Weight of Molten Mg in Bath 1040 g
Particles Sizes −20 mesh
Pellet Weight 10.4 g Diameter 222 mm Thickness 10.4 mm
Pellet Density 2.59 % Max. Theoretical Density 92
Compression Force 222 × $10^6$ Pa
Number of Pellets Added 1

Heat No. 204

| TIME FROM ADDITION Minutes | % Mn (analysis) | % Mn Recovery |
|---|---|---|
| 0 | <0.03 | — |
| 1 | <0.03 | — |
| 2 | 0.03 | — |
| 5 | 0.33 | 60 |
| 10 | 0.54 | 102 |
| 15 | 0.56 | 106 |
| 30 | 0.48 | 90 |
| 45 | 0.56 | 106 |

Heat No. 205

| TIME FROM ADDITION MINUTES | % Mn (analysis) | % Mn RECOVERY |
|---|---|---|
| 0 | <0.03 | — |
| 1 | 0.05 | 4 |
| 2 | 0.06 | 6 |
| 5 | 0.28 | 50 |
| 10 | 0.36 | 66 |
| 15 | 0.43 | 80 |
| 30 | 0.48 | 90 |
| 45 | 0.47 | 88 |

Average % Mn Recovery
For Heats 204 and 205

| TIME FROM ADDITION MINUTES | Ave % Mn RECOVERY |
|---|---|
| 0 | — |
| 1 | 2 |

TABLE 12-continued

| | |
|---|---|
| 2 | 3 |
| 5 | 55 |
| 10 | 84 |
| 15 | 93 |
| 30 | 90 |
| 45 | 97 |

TABLE 13

Pellet Composition 50 Mn 25 Al 25 Mg
Bath Temperature 725° C.
Percent Mn Addition 0.5
Weight of Molten Mg in Bath 1400 g
Particles Sizes −20 mesh
Pellet Weight 14 g Diameter 22.2 mm Thickness 12.8 mm
Pellet Density 2.82 g/cc % Max. Theoretical Density 86
Compression Force 222 × $10^6$ Pa
Number of Pellets Added 1

Heat No. 186

| TIME FROM ADDITION MINUTES | % Mn (analysis) | % Mn RECOVERY |
|---|---|---|
| 0 | <0.03 | — |
| 1 | <0.03 | — |
| 2 | <0.03 | — |
| 5 | <0.03 | — |
| 10 | 0.13 | 20 |
| 15 | 0.25 | 44 |
| 30 | 0.37 | 68 |

Heat No. 189

| TIME FROM ADDITION MINUTES | % Mn (analysis) | % Mn RECOVERY |
|---|---|---|
| 0 | <0.03 | — |
| 1 | <0.03 | — |
| 2 | 0.06 | 10 |
| 5 | 0.12 | 22 |
| 10 | 0.27 | 52 |
| 15 | 0.36 | 66 |
| 30 | 0.41 | 80 |

Average % Mn Recovery For Heats 186 and 189

| TIME FROM ADDITION MINUTES | Ave % Mn RECOVERY |
|---|---|
| 0 | — |
| 1 | — |
| 2 | 5 |
| 5 | 11 |
| 10 | 36 |
| 15 | 55 |
| 30 | 74 |

TABLE 14

Pellet Composition 50 Mn 25 Al 25 Mg
Bath Temperature 760°
Percent Mn Addition 0.5%
Weight of Molten Mg in Bath 1040 g
Particle Sizes −20 mesh
Pellet Weight 10.4 g Diameter 22.2 mm Thickness 8.8 mm
Pellet Density 3.04 % Max. Theoretical Density 92
Compression Force 222 × $10^6$ Pa
Number of Pellets Added 1

Heat No. 198

| TIME FROM ADDITION MINUTES | % Mn (analysis) | % Mn RECOVERY |
|---|---|---|
| 0 | <0.03 | — |
| 1 | <0.03 | — |
| 2 | 0.04 | 2 |
| 5 | 0.37 | 68.7 |
| 10 | 0.41 | 76.7 |
| 15 | 0.44 | 82.8 |
| 30 | 0.43 | 80.8 |
| 45 | 0.48 | 90.9 |

Heat No. 199

| TIME FROM ADDITION MINUTES | % Mn (analysis) | % Mn RECOVERY |
|---|---|---|
| 0 | <0.03 | — |
| 1 | <0.03 | — |
| 2 | <0.03 | — |
| 5 | 0.28 | 50 |
| 10 | 0.44 | 82 |
| 15 | 0.50 | 94 |
| 30 | 0.52 | 98 |
| 45 | 0.52 | 98 |

Average % Mn Recovery For Heats 198 and 199

| TIME FROM ADDITION MINUTES | Ave % Mn RECOVERY |
|---|---|
| 0 | — |
| 1 | — |
| 2 | 1 |
| 5 | 59.4 |
| 10 | 79.4 |
| 15 | 88.4 |
| 30 | 89.4 |
| 45 | 94.5 |

TABLE 15

Pellet Composition 50 Mn 25 Al 25 Mg
Bath Temperature 800° C.
Percent Mn Addition 0.5%
Weight of Molten Mg in Bath 1040 g
Particles Sizes −20 mesh
Pellet Weight 10.4 g Diameter 22.2 mm Thickness 8.8mm
Pellet Density 3.04 % Max. Theoretical Density 92
Compression Force 222 × $10^6$ Pa
Number of Pellets Added 1

Heat No. 200

| TIME FROM ADDITION MINUTES | % Mn (analysis) | % Mn RECOVERY |
|---|---|---|
| 0 | <0.03 | — |
| 1 | <0.03 | — |
| 2 | 0.06 | 6 |
| 5 | 0.41 | 76 |
| 10 | 0.47 | 88 |
| 15 | 0.55 | 104 |
| 30 | 0.53 | 100 |
| 45 | 0.58 | 100 |

Heat No. 201

| TIME FROM ADDITION MINUTES | % Mn (analysis) | % Mn RECOVERY |
|---|---|---|
| 0 | <0.03 | — |
| 1 | <0.03 | — |
| 2 | 0.04 | 2 |
| 5 | 0.35 | 64 |
| 10 | 0.42 | 78 |
| 15 | 0.45 | 84 |
| 30 | 0.50 | 94 |
| 45 | 0.50 | 94 |

Average % Mn Recovery For Heats 200 and 201

| TIME FROM ADDITION MINUTES | Ave % Mn RECOVERY |
|---|---|
| 0 | — |
| 1 | — |
| 2 | 4 |
| 5 | 70 |
| 10 | 83 |
| 15 | 94 |
| 30 | 97 |
| 45 | 97 |

TABLE 16

Pellet Composition 50 Mn 25 Al 25 Mg
Bath Temperature 725° C.
Percent Mn Addition 1.0
Weight of Molten Mg in Bath 1500 g
Particles Sizes −20 mesh TABLE 16-continued Pellet Weight 15 g Diameter 25.4 mm Thickness 9.7 mm
Pellet Density 3.06 g/cc % Max. Theoretical Density 93
Compression Force 263 × $10^6$ Pa
Number of Pellets Added 2

Heat No. 229

| TIME FROM ADDITION MINUTES | % Mn (analysis) | % Mn RECOVERY |
|---|---|---|
| 0 | <0.03 | — |
| 1 | .056 | 2.6 |
| 2 | .22 | 19 |
| 5 | .68 | 65 |
| 10 | .80 | 77 |
| 15 | .90 | 87 |
| 30 | .97 | 94 |
| 45 | .96 | 93 |

TABLE 17

Pellet Composition 50 Mn 25 Al 25 Mg
Bath Temperature 760°
Percent Mn Addition 1.0
Weight of Molten Mg in Bath 1500 g
Particles Sizes −20 mesh
Pellet Weight 15 g Diameter 25.4 mm Thickness 9.7 mm
Pellet Density 3.06 g/cc % Max. Theoretical Density 93
Compression Force 263 × $10^6$ Pa
Number of Pellets Added 2

Heat No. 218

| TIME FROM ADDITION Minutes | % Mn (analysis) | % Mn Recovery |
|---|---|---|
| 0 | <0.03 | — |
| 1 | 0.04 | 1. |
| 2 | 0.4 | 1. |
| 5 | .35 | 32 |
| 10 | .51 | 48 |
| 15 | .73 | 70 |
| 30 | .83 | 80 |
| 45 | .98 | 95 |

TABLE 18

Pellet Composition 50 Mn 25 Al 25 Mg
Bath Temperature 800° C.
Percent Mn Addition 1.0%
Weight of Molten Mg in Bath 1500 g
Particles Sizes −20 mesh
Pellet Weight 15 g Diameter 25.4 mm Thickness 9.7 mm
Pellet Density 3.06 g/cc % Max. Theoretical Density 93
Compression Force 263 × $10^6$ Pa
Number of Pellets Added 2

Heat No. 219

| TIME FROM ADDITION MINUTES | % Mn (analysis) | % Mn RECOVERY |
|---|---|---|
| 0 | <0.03 | — |
| 1 | .037 | 3.4 |
| 2 | .054 | 5.1 |
| 5 | .55 | 52 |
| 10 | .76 | 73 |
| 15 | .87 | 84 |
| 30 | .86 | 83 |
| 45 | 1.01 | 98 |

TABLE 19

Pellet Composition 50 Mn 25 Al 25 Mg
Bath Temperature 725° C.
Percent Mn Addition 1.5%
Weight of Molten Mg in Bath 1500 g
Particles Sizes −20 mesh
Pellet Weight 15 g Diameter 25.4 mm Thickness 9.7 mm
Pellet Density 3.06 g/cc % Max. Theoretical Density 93
Compression Force 263 × $10^6$ Pa
Number of Pellets Added 3

Heat No. 220

| TIME FROM ADDITION MINUTES | % Mn (analysis) | % Mn RECOVERY |
|---|---|---|
| 0 | <0.03 | — |
| 1 | <0.03 | — |
| 2 | .046 | 1 |
| 5 | .30 | 18 |
| 10 | .47 | 29 |
| 15 | .64 | 41 |
| 30 | .85 | 55 |
| 45 | .98 | 63 |

TABLE 20

Pellet Composition 50 Mn 25 Al 25 Mg
Bath Temperature 760° C.
Percent Mn Addition 1.5%
Weight of Molten Mg in Bath 1500 g
Particles Sizes −20 mesh
Pellet Weight 15 g Diameter 25.4 mm Thickness 9.7 mm
Pellet Density 3.06 g/cc % Max. Theoretical Density 93
Compression Force 263 × $10^6$ Pa
Number of Pellets Added 3

Heat No. CC221

| TIME FROM ADDITION MINUTES | % Mn (analysis) | % Mn RECOVERY |
|---|---|---|
| 0 | <0.03 | — |
| 1 | <0.03 | — |
| 2 | 0.046 | 1.1 |
| 5 | 0.41 | 25.3 |
| 10 | 0.67 | 42.7 |
| 15 | 0.92 | 59.3 |
| 30 | 1.10 | 71.3 |
| 45 | 1.16 | 75.3 |

TABLE 21

Pellet Composition 50 Mn 25 Al 25 Mg
Bath Temperature 800° C.
Percent Mn Addition 1.5%
Weight of Molten Mg in Bath 1500 g
Particles −20 mesh
Pellet Weight 15 g Diameter 25.4 mm Thickness 9.7 mm
Pellet Density 3.06 g/cc % Max. Theoretical Density 93
Compression Force 263 × $10^6$ Pa
Number of Pellets Added 3

Heat No. CC222

| TIME FROM ADDITION MINUTES | % Mn (analysis) | % Mn RECOVERY |
|---|---|---|
| 0 | <0.03 | — |
| 1 | 0.034 | 1 |
| 2 | 0.058 | 1.9 |
| 5 | 0.54 | 34 |
| 10 | 0.89 | 57.3 |
| 15 | 1.10 | 71.3 |
| 30 | 1.20 | 78 |
| 45 | 1.26 | 82 |

The average values for the percent manganese recovered in the bath with respect to time were plotted conventionally in the drawing for the 50% manganese-50% magnesium additions at magnesium bath temperatures of 725° C. (Table 1, 4, 7 and 10) and 800° C. (Table 3, 6, 9 and 12). The band enclosed by the 725° C. average recovery curve and the 800° C. average recovery curve as shown in the drawing would be a representative range of manganese recoveries in accordance with the method of the present invention.

Thus the drawing and the foregoing examples show the improved manganese recovery in a molten magnesium bath by the method of the present invention with respect to the recovery of manganese by the addition of elemental manganese flake to a molten magnesium bath.

The average values for the percent manganese recovered in the bath with respect to time was plotted in the drawing for the 50% Mn, 25% Mg and 25% Al additions at bath temperatures of 725° C. and 800° C. as before. The drawing and the examples show that aluminum replacing up to one half of the magnesium in the blended mixture has no detrimental effect on the manganese recovery in the bath.

As hereinbefore disclosed, the finely divided manganese-magnesium mixture of the present invention would preferably be added to the molten magnesium bath in the form of a compact or pellet. However, the mixture of the finely divided manganese and magnesium may be added to the bath in an uncompacted form, e.g. wrapped in metal foil or enclosed in a consumable container.

The mesh sizes referred to herein are United States sieve series.

What is claimed is:

1. A method for making manganese additions to a molten magnesium bath which comprises introducing into the molten magnesium bath a blended mixture consisting essentially of finely divided manganese and a finely divided metal selected from the group consisting of magnesium and magnesium base alloys containing at least 90 percent magnesium wherein the ratio of manganese to magnesium by weight in the mixture is from about ¼ to 8 and the ratio of magnesium to manganese by weight in the mixture is from about 4 to ⅛ so that the manganese addition is substantially dissolved in the molten magnesium bath at a rate substantially greater than that which would be obtained by the addition of elemental manganese and with substantially complete retention of the finely divided manganese and magnesium addition.

2. A method in accordance with claim 1 wherein the blended mixture consists essentially of from about 40 percent to about 60 percent by weight finely divided manganese and from about 60 percent to about 40 percent by weight a finely divided metal selected from the group consisting of magnesium and a magnesium base alloy containing at least 90 percent magnesium.

3. A method in accordance with claim 1 wherein the blended mixture consists essentially of about 50 percent by weight finely divided manganese and about 50 percent by weight a finely divided metal selected from the group consisting of magnesium and a magnesium base alloy containing at least 90 percent magnesium.

4. A method in accordance with claim 1 wherein the blended mixture is in the form of compacts having a density of from about 80 to 97 percent the maximum theoretical density.

5. A method in accordance with claim 1 wherein the blended mixture is in the form of compacts having a density of from about 90 to 97 percent the maximum theoretical density.

6. A method in accordance with claim 4 wherein the blended mixture is substantially all finer than 8 mesh.

7. A method in accordance with claim 4 wherein the blended mixture is substantially all finer than 20 mesh.

8. A method in accordance with claim 4 wherein the blended mixture is substantially all finer than 30 mesh.

9. A method in accordance with claim 5 wherein the blended mixture is substantially all finer than 8 mesh.

10. A method in accordance with claim 5 wherein the blended mixture is substantially all finer than 20 mesh.

11. A method in accordance with claim 5 wherein the blended mixture is substantially all finer than 30 mesh.

12. A method for making manganese additions to a molten magnesium bath which comprises introducing into the molten magnesium bath a blended mixture consisting essentially of about 50 percent by weight finely divided electrolytic manganese and about 50 percent by weight commercially pure magnesium wherein the metal addition is substantially dissolved in the molten magnesium bath at a rate substantially greater than that which would be obtained by the addition of elemental manganese and with substantially complete retention of the finely divided manganese and magnesium addition wherein the blended mixture is in the form of a compact having a density of about 2.7 gm/cc. and wherein the blended mixture is all substantially finer than 20 mesh.

* * * * *